US011351445B2

(12) United States Patent
Tevis et al.

(10) Patent No.: US 11,351,445 B2
(45) Date of Patent: Jun. 7, 2022

(54) SCRATCH-OFF COATINGS COMPATIBLE WITH DIGITAL IMAGING

(71) Applicant: Hydragraphix LLC, New York, NY (US)

(72) Inventors: Mark Chiles Tevis, Novato, CA (US); Fred W. Finnerty, Dawsonville, GA (US); Kenneth E. Irwin, Dawsonville, GA (US)

(73) Assignee: HYDRAGRAPHIX LLC, New York, NY (US)

( * ) Notice: Subject to any disclaimer, the term of this patent is extended or adjusted under 35 U.S.C. 154(b) by 0 days.

(21) Appl. No.: 16/758,154

(22) PCT Filed: Oct. 22, 2018

(86) PCT No.: PCT/US2018/056863

§ 371 (c)(1),
(2) Date: Apr. 22, 2020

(87) PCT Pub. No.: WO2019/083880

PCT Pub. Date: May 2, 2019

(65) Prior Publication Data

US 2020/0282298 A1 Sep. 10, 2020

Related U.S. Application Data

(60) Provisional application No. 62/575,821, filed on Oct. 23, 2017.

(51) Int. Cl.

| | |
|---|---|
| ***A63F 3/06*** | (2006.01) |
| ***B42D 25/27*** | (2014.01) |
| ***B41M 5/124*** | (2006.01) |
| ***B41M 5/50*** | (2006.01) |

(52) U.S. Cl.

CPC ..... *A63F 3/0665* (2013.01); *A63F 3/065* (2013.01); *B41M 5/1246* (2013.01); *B41M 5/502* (2013.01); *B42D 25/27* (2014.10); *A63F 2003/066* (2013.01)

(58) Field of Classification Search

CPC .... A63F 3/0065; A63F 3/0665; A63F 3/0655; A63F 3/066; A63F 3/065

See application file for complete search history.

(56) References Cited

U.S. PATENT DOCUMENTS 4,540,628 A * 9/1985 Oberdeck ..... A63F 3/0665 283/903
5,532,046 A * 7/1996 Rich ..... A63F 3/0665 283/100
5,569,512 A * 10/1996 Brawner ..... A63F 3/0665 283/100

(Continued)

OTHER PUBLICATIONS

PCT Application Serial No. PCT/US2018/056863, International Search Report & Written Opinion, dated Jan. 3, 2019, 16 pages.

(Continued)

*Primary Examiner* — Kyle R Grabowski
(74) *Attorney, Agent, or Firm* — Neal, Gerber & Eisenberg LLP

(57) ABSTRACT

A security-enhanced document with a removable SOC is provided that is compatible with process color digital imaging, method and system for producing the document enhances production, and expands the aesthetics of the documents.

19 Claims, 6 Drawing Sheets

(56) References Cited

U.S. PATENT DOCUMENTS

| | | | | |
|---|---|---|---|---|
| 5,654,039 | A | 8/1997 | Wenzel et al. | |
| 5,667,250 | A * | 9/1997 | Behm | A63F 3/0685 283/102 |
| 5,681,065 | A * | 10/1997 | Rua, Jr | A63F 3/0665 283/72 |
| 5,959,020 | A | 9/1999 | Oliveri et al. | |
| 6,232,361 | B1 | 5/2001 | Laksin et al. | |
| 9,861,883 | B1 * | 1/2018 | Gaynor | A63F 3/0665 |
| 2007/0164559 | A1 | 7/2007 | Kozdras | |
| 2010/0098887 | A1 | 4/2010 | Matsuishi et al. | |
| 2012/0025516 | A1 * | 2/2012 | Miller | A63F 3/0655 283/100 |
| 2012/0267888 | A1 * | 10/2012 | Behm | B42D 25/378 283/100 |
| 2017/0209781 | A1 * | 7/2017 | Gaynor | A63F 3/0665 |

OTHER PUBLICATIONS

PCT Application Serial No. PCT/US2018/056863, International Preliminary Report on Patentability, dated Dec. 10, 2019, 15 pages.

* cited by examiner

SCRATCH-OFF COATINGS COMPATIBLE WITH DIGITAL IMAGING

CROSS-REFERENCE TO RELATED APPLICATIONS

This application claims priority to U.S. Provisional Patent Application No. 62/575,821 filed Oct. 23, 2017, which is incorporated herein by reference.

BACKGROUND OF THE INVENTION

1. Field of the Invention

The present invention is the innovation of ink films for enabling contests or lotteries preferably utilizing tickets or documents with variable indicia hidden under a Scratch-Off Coating (SOC) to digitally image, via ink jet or other techniques, variable or non-variable image above and below SOC ink films. Specifically, this innovation resolves the problem of producing SOC ink films that are compatible with off-the-shelf digital imager applications both in terms of printing SOC ink films on top of a digitally imaged substrate, as well as digital imaging overprints on a SOC substrate.

2. Background

Lottery scratch-off or instant games have become a time-honored method of raising revenue for state and federal governments the world over. Indeed, the concept of hiding variable indicia information under a SOC has also been applied to numerous other products such as commercial contests, telephone card account numbers, gift cards, etc. The variable indicia are the letters, numbers, images or other indicia which determine whether a ticket is a winner typically by identically matching two or more of the letters, numbers, images, or other indicia that are part of the variable indicia under the SOC. Literally, billions of scratch-off products are printed every year where the SOCs are used to ensure that the product has not been previously used, played, or modified.

Typically, the variable indicia are printed using a specialized monochromatic high-speed ink jet with a water-based ink imaged on top of fixed plate printed (e.g., gravure, flexographic, etc.) ink film security layers that provide opacity, physical barriers, chemical barriers, and a higher contrast background for the ink jet variable indicia. The purpose is to ensure that the printed variable indicia cannot be read or decoded without first removing the associated SOC, thereby ensuring that a game or product is secure against picking out winners or extracting confidential information from unsold tickets or documents.

However, there are known methods (e.g., wicking, vapor, steam, alcohol soaks) for diffusing the ink jet variable indicia through the front or top SOC or through the back of the ticket. When carefully applied, these methods can temporally reveal the previously hidden variable indicia, thereby enabling people to illicitly determine if a given ticket is a winner or non-winner while leaving little or no trace, thereby only selling losing tickets to the public. The pick-out of winning variable indicia is made possible by a positive Signal-to-Noise (S/N) ratio of the diffused ink jet image through the substrate of the ticket or the SOC relative to the ticket's background ink noise.

In addition to diffusion, techniques have been developed for inducing fluorescence in the ink jet variable indicia dye.

In these fluorescence attacks the variable indicia dye is made to fluoresce with the ticket background not emitting any light or no light in the same wavelength as the fluorescing variable indicia ink jet image. Since the variable indicia emit fluorescent light in a wavelength different from the excitation source and the ticket background, there is a relatively high S/N ratio established between the fluorescence emissions of the variable indicia and the ticket's excitation light background. This relatively high S/N ratio allows for filtered (i.e., using a narrow band optical filter only allowing fluorescent wavelength light to pass) timed exposures with digital cameras that can successfully capture variable indicia images through an intact SOC that are not necessarily discernable by the human eye. This again allows for illicit pick-out of winning tickets with only losing tickets being sold to an unsuspecting public.

Similar to the above diffusion and fluorescence techniques, electrostatic charges have also been applied to instant tickets with intact SOCs, creating a differential charge in the hidden ink jet variable indicia. If an electrostatically sensitive powder (e.g., baby powder) is applied over the SOC, the powder will align in the two-dimensional shape of the (previously) hidden variable indicia, yet again allowing for the underlying variable indicia to be viewed over an intact SOC and allowing winning tickets to be picked out. When the charge is removed and the powder brushed away, no indication remains that the ticket's integrity was compromised. The electrostatic attack is based on establishing a positive S/N ratio of the ink jet variable indicia's charge relative to the ticket's background ink noise.

All of these variable indicia compromise practices have been mitigated with elaborate countermeasures meticulously developed in the instant ticket industry over decades. Most of these countermeasures rely on various printed (via a fixed plate—i.e., non-variable) barriers to resist the aforementioned attacks. The general concept is to secure the variable ink jet indicia image and chemistry with SOC chemical barrier layer(s) reducing the variable indicia's S/N ratio to near unity or below relative to the ticket's background unless the SOC has been removed.

Thus, the seemingly simple SOC ink films have become exceedingly chemically complex countermeasures developed over decades. When it is appreciated that the SOC ink films must also provide countermeasures for known techniques for mechanically "lifting" the SOC and thereby illicitly viewing the variable indicia, it can be appreciated that the SOC ink chemistry is both highly complex and delicate.

The term "mechanical lift" refers to a process that uses a flat blade (e.g., X-Acto chisel blade #17) or other device to peel back a portion of the SOC to reveal previously hidden variable indicia. The lifted SOC is then glued back into place such that it is not obvious that the integrity of the coating has been breached. The industry has developed countermeasures to the previously described mechanical lift technique which involve changing the formulation of the SOC so that it is more difficult to remove and/or it flakes off or crumbles, rather than peeling off in one piece, thereby making "unassisted" SOC lifts more difficult.

As such, it is extremely difficult to modify any ink film layer in the SOC "security stack" of an instant ticket or document protecting the hidden variable or other indicia since these ink films must not only meet all security requirements, but must also scratch-off in a clean and easy fashion, be completely safe for handling by humans, and ultimately provide a white or neutral background for decorative display overprinting.

Recent digital printing innovations make it both economically feasible and desirable to print full-color variable indicia rather than the prior art's monochromatic variable indicia. This full-color variable indicia (i.e., process colors, typically printed with varying percentages of Cyan, Magenta, Yellow, and blacK—a.k.a. "CMYK" is desirable, not only for the greatly increased aesthetic properties, but also for enabling new types of games, as well as helping persons with poor eyesight more readily identify winning and losing variable indicia patterns. Additionally, it is desirable for the overprint portion(s) of SOC ink films (i.e., the decorative patterns or images printed on top of intact SOC ink film coatings) to also be digitally imaged with full-color process thereby providing greater variety, higher quality overprints, and possibly overprints digitally linked to game play.

However, a majority of the known suitable digital printing techniques require that the digital imaging be applied to "primed" substrates that are receptive to the digital imaging process, providing appropriate graphic adhesion, chemical stability, as well as a suitable high contrasting background. Thus, digitally imaging variable indicia under SOC ink layers, as well as overprinting directly on top of the SOC ink films, poses unique challenges particularly when it is realized that the existing prior art SOC ink chemistry is both highly complex and delicate and has evolved over decades.

It is therefore highly desirable to develop techniques and methodologies for ensuring the security and integrity of scratch-off tickets and documents that retains and enhances the required countermeasure technology of SOC layers, thereby offering a robust and generic defense while at the same time providing a suitable substrate or background for full color digital imaging overprints. Ideally, the existing SOC ink films should be modified as little as possible to ensure that countermeasures developed over decades are preserved.

SUMMARY OF THE PRESENT INVENTION

Objects and advantages of the invention will be set forth in part in the following description, or may be apparent from this description, or may be learned through practice of the invention.

This invention relates to a security-enhanced document with a removable SOC that is compatible with process color digital imaging, which may be an instant lottery ticket in certain embodiments. Additionally, this invention also relates to providing a foundation for a stack of SOC ink films over a primer (primer coating) that is receptive to process color digital imaging. In another aspect of this invention, the stack of SOC ink films are modified to include a primer to accommodate a process color overprint such that the process color overprint will remain inert and color fast when exposed to various environmental disruptions (e.g., water, alcohol, exposure to sunlight).

A first aspect relates to a method of producing a security-enhanced document comprising a substrate, variable indicia, and a number of SOC layers applied over four or more process color variable indicia to maintain the variable indicia unreadable until the composite SOC layers are removed by being scratched off. The method comprises printing a barrier or release coat between the imaged process color variable indicia and associated primer and the SOC ink layer stack. The barrier or release coat being substantially transparent while also being principally chemically inert to subsequent SOC ink films, thereby insulating the SOC ink films from unwanted chemical reactions with the digital imager primer, consequently allowing subsequent prior art SOC ink films to remain relatively chemically unaltered.

A second aspect of the invention concerns printing the composite SOC ink films such that the SOC functions as a high contrast primer that is receptive to a process color overprint applied by digital imaging (e.g., digitally process color ink jet), such that the overprint bonds with the SOC, ensuring that the overprint appears vibrant and is resistant to water and other solvents. In this embodiment, the upper white layer(s) of prior art SOC ink film stacks are chemically modified to include primer that is receptive to the digitally imaged CMYK process overprint. The upper layer(s) of the SOC itself thereby function(s) as a primer for the digitally processed CMYK color image. This embodiment has the advantage of no additional ink film applications with the disadvantage of chemically modifying the upper SOC ink film layer(s).

In a preferred embodiment of the second aspect, the security-enhanced document's SOC does not include any portions of a primer, but rather functions as a stable ink film foundation in which additional digital imager compatible primer ink film(s) is/are applied. This added primer ink film(s) provide(s) a receptive medium for digital imaging a process color overprint (e.g., ink jet), such that the overprint bonds with the added primer, ensuring a vibrant appearance as well as resistance to water and other solvents. As a result, this preferred embodiment has the advantage of leaving the prior art SOC ink film stack relatively unchanged with the disadvantage of adding at least one or more print station(s) to the press to accommodate the added primer.

In another embodiment, a clear, colorless, and transparent overprint is applied to the security-enhanced document's SOC and optionally the display area. The clear, colorless, and transparent overprint imparts an aesthetically pleasing gloss appearance as well as provides additional protection, thereby ensuring a stable and uniform appearance for digitally imaged process colors when accidentally wetted with various solutions—e.g., water, alcohol, cola.

In most of these embodiments, the prior art SOC ink film stack remains predominately unchanged, thereby allowing the delicate security countermeasures developed over decades to remain relatively intact. The essential concepts of the invention are to provide a foundation for a SOC ink film stack that allows it to perform its primary functions unimpeded, as well as add primer layer(s) to or modify the upper SOC portion(s) to include process color digital imaging. Thus, this invention allows for full process color digital imaging beneath and/or on top of a SOC protected document with minimal disruption of existing security countermeasures.

Described are a number of printing mechanisms and methodologies that provide practical details for reliably producing a SOC that can be printed on top of and is receptive to at least one application of a process color digital imager. Although the examples provided herein are primarily related to instant tickets, it is clear that the same methods are applicable to any type of document (e.g., telephone card) where information is protected by a SOC.

DETAILED DESCRIPTION OF THE INVENTION

Figure 1:
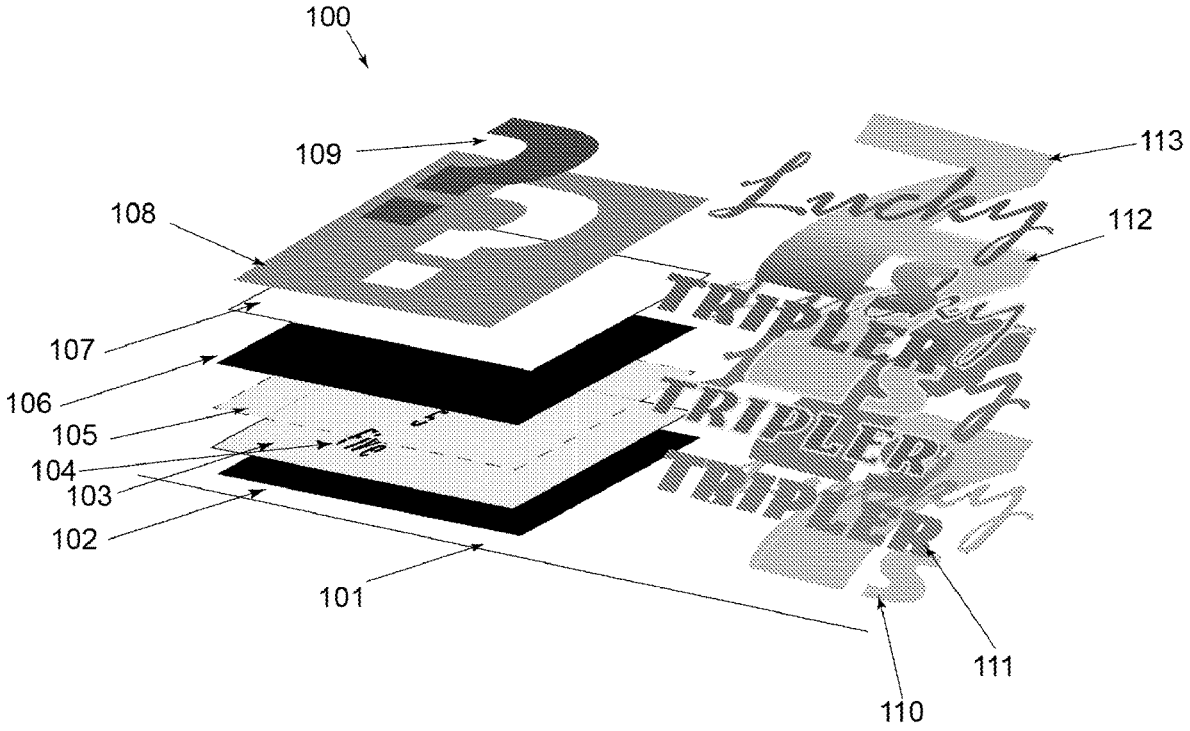
FIG. 1 PRIOR ART
FIG. 1 is a prior art exploded top isometric view of a representative example of a traditional lottery-type instant ticket security SOC ink film stack.

Certain terminology is used herein for convenience only and is not to be taken as a limitation on the present invention. The words "a" and "an", as used in the claims and in the corresponding portions of the specification, mean "at least one."

The terms "scratch-off game piece" or other "scratch-off document," hereinafter are referred to herein generally as an "instant ticket" or simply "ticket." Additionally, the terms "full-color", "four-color", and "process color" are also used interchangeably throughout the specification as terms of convenience for producing a variety of colors by discrete combinations of applications of pigmented primary inks or dyes "CMYK" (i.e., Cyan, Magenta, Yellow, and blacK), or in some cases six colors (e.g., Hexachrome printing process uses CMYK inks plus Orange and Green inks), or alternatively eight colors—e.g., CMYK plus lighter shades of cyan (LC), magenta (LM), yellow (LY), and black (YK), using a digital printing process, rather than using a fixed plate printing process.

The term "web" as used herein refers to a continuous substrate threaded through an inline printing press that receives printing inks and/or dyes, thereby forming printed documents. The term "security stack" as used herein means multiple ink film layers printed on top of at least a portion of the lower layer(s) protecting the variable indicia from disclosure until the SOC has been removed. The printing "layers" mentioned herein may be applied in any form and in any image, and for many of the layers, not edge to edge of the ticket or other document. Thus, "layers" as used herein is equivalent to "areas" or "portions" of printed images or other indicia. In the context of this invention, the terms "front" and "top" are used interchangeably, referring to the side of a ticket or document with indicia secured by a SOC. Likewise, the terms "back" and "bottom" are also used interchangeably, referring to the opposite side of a ticket or document. When discussing the various ink film layers printed on top of each other, the terms "upper", "lower", "top", and "bottom" disclose an ink film's proximity relative to the stack of ink films printed on top of each other. Also, the term "ink" as used herein refers to a printing ink with solid particles suspended in the solution that ultimately adhere to the printed document. In contrast, the term "dye" as used in this specification, refers to printing solutions with very little or no physical particles where the printed surface is effectively stained by the dye thereby creating a printed image. Finally, the term "physical image" as used herein refers to the image printed on the web by a digital imager (e.g., ink jet, bubble jet).

Before describing the present invention, it may be useful to first provide a brief description of the current state of the art of instant ticket production, to help understand the distinctions between the prior art and the present invention. This is to ensure that a common lexicon is established with respect to existing systems prior to disclosing the present invention. This description of the current state of the art of instant ticket production is provided in the discussion of FIG. 1 for instant tickets. Thus, any reference to the portions of components of the prior art scratch-off tickets of FIG. 1 as may be described with respect to the other drawings and methods of the present invention illustrating various ink film layers, does not mean that the other drawings constitute prior art.

FIG. 1 depicts a representative example of the variable indicia and associated security ink stack typical of a traditional (i.e., prior art) ink jet SOC secured document—e.g., an instant lottery ticket 100. As shown in FIG. 1, the printed variable indicia 104 are between lower security ink films 102 and 103 and upper security ink films 105, 106, and 107 in an attempt to provide barriers protecting the variable indicia 104 from diffusion, fluorescence, electrostatic, and other known attacks.

The entire ink film stack is deposited on a paper or other substrate 101. The lower security-ink film layers include a Lower Blocking Black (LBB) layer 102 providing opacity and diffusion barriers, as well as a higher contrast (e.g., white or gray against a black or other dark color) background primer layer(s) 103, such that a human consumer can read the monochromatic variable indicia 104. The upper security ink film layers also isolate the variable indicia 104, first with a release coating 105 that helps seal the variable indicia to the substrate 101 and causes any subsequent ink films printed on top of the variable indicia 104 to scratch-off. The SOC comprises one or more layers, and typically several, so that the variable indicia 104 are not visible until the ticket is played by the SOC being legitimately scratched off. The SOC layer(s) of exemplary ticket 100 comprise(s) at least one upper opacity layer 106 applied to help protect against candling and fluorescence attacks. On top of the opacity layer(s), at least one white ink film 107 is typically applied that provides a higher contrast background for overprint inks. Finally, decorative overprint ink areas or layers 108 and 109 are applied via fixed plate printing (e.g., flexographic, gravure, offset) for both an attractive appearance of the SOC area, as well as sometimes providing additional security.

In addition to the security ink stack and variable indicia of areas or layers 102 through 109 of ticket 100, the ticket also has printed decorative display area layers 110 through 113 designed to make the ticket 100 more attractive and provide instructions for game play. Typically, this display area printing is printed via an offset or flexographic (i.e., fixed printing plate) process where the four primary printing colors Cyan 110, Magenta 111, Yellow 112, and blacK 113 (i.e., CMYK) are blended in varying intensity to mimic all colors perceived by a human. However, other fixed plate printing processes and techniques (e.g., gravure) may be used if desired.

Thus, many security ink film layers (seven in the example of FIG. 1) are required to protect and allow for only legitimate consumer readability of the variable indicia 104 of a traditional SOC protected document, such as an instant lottery ticket. Of course, the example of FIG. 1 is just one possible arrangement of a traditional prior art SOC protected document with security ink films, with the goal of any security ink film coating arrangement being to provide barriers to attempts to detect the variable indicia without properly removing the SOC.

Among other shortcomings, the prior art security ink stack of document 100 of FIG. 1 has the disadvantage of utilizing fixed plate printing (e.g., flexographic, offset) for the display (110 through 113) and overprints (108 through 109), as well as monochromatic imaging for the variable indicia 104. Thus, the variability of the prior art document's display (110 through 113) and overprints (108 through 109) are limited. Additionally, prior art variable indicia are monochromatic and typically of relatively low resolution (e.g., 240 dpi—"dots per inch") resulting in a degraded appearance that is sometimes hard to identify correctly for people, particularly those with poor eyesight.

Reference will now be made in detail to examples of the invention, one or more embodiments of which are illustrated in the drawings. Each example is provided by way of explanation of the invention, and not meant as a limitation of the invention. For example, features illustrated or described as part of one embodiment, may be used with another embodiment to yield still a further embodiment. It is intended that the present invention encompasses these and other modifications and variations as come within the scope and spirit of the invention.

Figure 2:
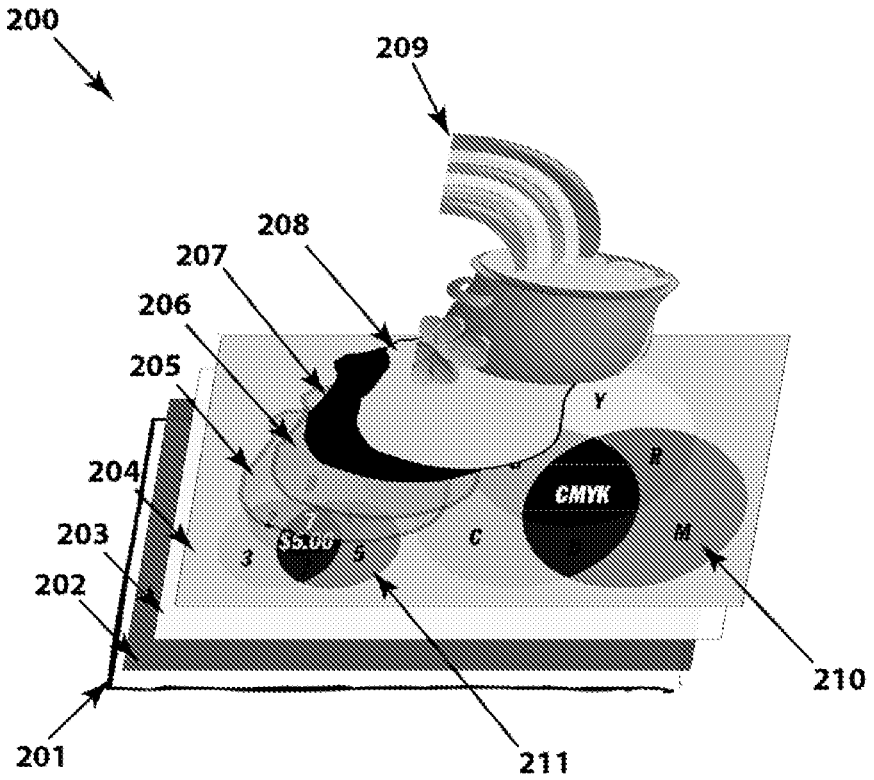
FIG. 2 is an exploded top isometric view of a first representative example of a lottery-type instant ticket security SOC ink film stack compatible with process color digital imaging of variable indicia, display, and overprint.

Fortunately, these shortcomings and others can be overcome with the invention 200 of FIG. 2. FIG. 2 illustrates an exploded top isometric view of a representative example of a first embodiment 200 of a SOC secured document compatible with CMYK process color digital imaging of the variable indicia 211 (also, referred to herein as "digitally imaged process color indicia"), display 210, and overprint 209 (also, referred to herein as "digitally imaged process color overprint").

As illustrated in FIG. 2, with embodiment 200, the paper or other substrate 201 is typically first flood coated with an opacity layer(s) 202 providing optical and diffusion barriers similar to prior art LBB 102 of FIG. 1. Next, returning to FIG. 2, a higher contrast white background layer 203 is applied, also typically flood coated—though under some circumstances, it may be preferable for both the opacity and contrast layers to be spot coated. However, with SOC secured documents providing process color imaging, this contrast layer(s) 203 may only contain white or gray pigmented ink particles (e.g., titanium dioxide) and not necessarily also include a primer compatible with process color digital imaging (e.g., ink jet dye). This is primarily to allow a higher pigment loading of the contrast layer 203, thereby imparting greater opacity and consequently higher contrast—i.e., a "whiter" background to better display process color imaging.

Typically, on top of the flood coated contrast layer 203, a primer 204 is applied, also typically flood coated. This primer 204 is typically hydrophilic (also, referred to herein as "a process color hydrophilic primer"), thereby allowing it to readily absorb water based ink jet droplets as they are applied by digital imagers, thereby providing a foundation for the desired stable and uniform variable indicia 211 and display 210 images. The primer 204 provides a foundation that imparts water and optionally alcohol fastness to the applied ink jet image ink or dye droplets, as well as enhances the sharpness and vibrancy of the printed variable indicia 211 and display 210 images. With pigmented ink jet process color printed indicia 211 and display 210 applications, the primer 204 can be deposited as a relatively thin single ink film application (e.g., 12 BCM—"Billion Cubic Microns") or optionally combined with the contrast layer 203. Conversely, when the process color ink jet droplets are dye based (i.e., colored solution that prints an image by staining the applied surface), the primer layer 204 is especially important since the 100% or near 100% solution must be primarily absorbed into the surface it is applied to ensure fastness as well as ease of convection or infrared drying at speed (e.g., ≥350 FPM—"Feet Per Minute") on the printing press. In some applications of dye based saturated process color printing, it may be desirable to apply two separate applications of the optional primer layer 204 to ensure that a sufficient amount of primer ink film is present to absorb the ink jet dye—e.g., a first application of 12 BCM and a second application of 21 BCM.

However, by its very nature, the primer 204 tends to interact with any ink films applied on top of it. This interaction typically has the disadvantage of attracting or wicking the liquid portions of any subsequent applied ink film typically leaving only the solid portions of the ink on the surface above the primer 204. Thus, any subsequently applied ink film no longer is comprised of its intended chemistry with its liquid portions tending to be absorbed by the primer 204 and its solid portions remaining on the surface of the primer 204, resulting in incomplete curing, low graphic adhesion, and/or other problems. Regrettably, this subsequent ink primer 204 absorption problem is applicable to both water based convection or infrared and direct energy (e.g., Ultraviolet or "UV", electron beam) cured inks.

It is therefore highly desirable to provide a barrier or sealer ink film layer 205 directly on top of any primer 204 after the indicia 211 are printed. This sealer ink film layer 205 saturates the underlying primer 204 layer, thereby rendering the primer 204 chemically inactive to subsequent ink film layers applied on top of the sealer ink film layer 205. As shown in FIG. 2, the sealer ink film layer 205 would be applied immediately after the process color digital imaging display 210 and variable indicia 211 were printed on the primer. With a substantially clear, colorless, and transparent seal layer 205, the printed variable indicia 211 and, optionally, the display 210 (i.e., flood coated) would be readily visible to the human consumer as well as providing additional protection of the printed display 210 and variable indicia 211 against water, alcohol, and other chemicals coming into contact with the document's surface. In a preferred embodiment, the seal layer 205 imparts a glossy finish to the printed process color digital imaging variable indicia 211 and optionally, display 210 thereby enhancing appearance.

Thus, the seal ink film layer 205 chemistry is primarily intended to seal the porous surface of the primer layer 204 so that excessive absorption of the subsequent inks or coatings—e.g., release coat 206, Upper Blocking Black (UBB) 207, white SOC 208—does not occur. In particular, if the subsequent release coat 206 is significantly absorbed by the primer, there will remain insufficient release coat 206 material in the resulting ink film to provide a good clean scratch-off release of subsequent upper or higher ink films in the security stack.

The seal ink film layer 205 chemistry can be either water based (i.e., convection or infrared drying) or direct energy curable (e.g., UV, electron beam) so long as the deposited seal ink film layer 205 exhibits similar functional characteristics. For water based seal ink film layer 205 embodiments, there are many resin systems (i.e., polymeric solids) available that would provide satisfactory performance with most primer layer 204 applications. Examples of suitable resin systems would be: acrylics, acrylic copolymers, rosin esters, EVCL (Ethylene-Vinyl Chloride), etc. However, in preferred embodiments, a free radical based energy curable seal ink film layer 205 comprised of oligomers such as epoxy acrylates, urethane acrylates, polyester acrylates, and acrylic acrylates, combined with acrylate monomers will typically seal the porous surface of the primer layer 204 with the best efficiency in terms of ink volume required. This efficiency of ink volume is achieved because typically 100% of the solids are deposited in energy curable ink film layers as opposed to water based ink film layers were a substantial portion of the ink volume is removed due to evaporation. In circumstances where free radical based energy curable seal ink 205 formulations are undesirable, direct energy (such as UV or electron beam) curable cationic chemistry such as formulations based upon cycloaliphatic diepoxides could provide an alternative preferred embodiment, though potentially with the disadvantage of a higher cost.

Regardless of the underlining curing chemistry, generally the seal ink film layer 205 viscosity should be high relative to typical printing viscosity ranges, (e.g., greater than or equal to 25 seconds viscosity with a #2 Zahn cup) thereby minimizing dive-in or absorption of ink from adjacent layers. Additionally, it may be desirable to build in thixotropy by utilizing inorganic or organic rheology modifiers, in this case thixotropes to the seal ink film layer 205 provide a shear thinning formulation that will increase in viscosity with removal of the shear of the printing process—i.e., once the seal ink film layer 205 is applied to the primer layer 204 it stops flowing and thus intermingling of ink between the layers is minimized. Ideally, a thick seal ink film layer 205 should be flexographically deposited via an application anilox roller with volumes of 24 BCM or greater.

The seal coat 205 could be applied either flood coated or confined just to the variable indicia area 211 (as illustrated in FIG. 2) of the document. In either case, the seal coat 205 provides protection for the printed process color imaging, as well as effectively rendering the primer coating 204 effectively chemically inert, thereby allowing prior art formulated ink films to be printed on top of the seal coat 205 without the need for significant modifications of the top-coated ink films. The first of these prior art ink films is a clear release coat 206 applied on top of the sealer 205 that ensures any subsequent ink films printed on top of the release coat is removable by scratching. Typically, the release coat 206 is direct energy cured (e.g., ultraviolet or electron beam) to apply as thick and as consistently strong an ink film coating as possible—e.g., applied with an Anilox roller with an 120 line screen and 15 BCM resulting in a typical ink film thickness of approximately 0.0004 inch or 10 μm. The release ink film coating 206 could be confined just to the variable indicia area 211 of the document (as illustrated in FIG. 2) or applied via flood coating across the entire surface of the document. On top of the release ink film coating 206 an upper opacity layer 207, typically referred to as an Upper Blocking Black (UBB), is printed, providing upper security against candling (i.e., coupled with the lower security LBB) and protection from fluorescence attacks—i.e., where an excitation light source of one wavelength is used to induce fluorescence in the variable indicia in a different wavelength, thereby compromising the indicia without removing the SOC. Printed on top of the UBB 207 is a white SOC base 208 that provides a neutral background for overprint image(s) 209.

However, with this invention of SOC secured documents compatible with process color digital imaging, the SOC 208 is chemically modified to also include a primer that is typically hydrophilic, thereby allowing it to readily absorb water based ink jet droplets as they are applied by digital imagers, creating the desired stable and uniform overprint image 209. The combination SOC and primer 208 provide a foundation that imparts water and optionally alcohol fastness to the applied ink jet image droplets, as well as enhance the sharpness and vibrancy on the ink jet image.

The combined SOC and primer 208 chemistry is preferably a water based formulation. The combined SOC and primer would also contain inorganic fillers for water absorption, such as silica. However, these fillers have to be carefully selected in order to ensure no interference with curing.

Thus, the embodiment of the enhanced security protected document 200 has the advantage of enabling a predominately unaltered prior art scratch-off ink stack to be compatible with process color digital imaging. However, this embodiment has the disadvantage of chemically altering the white SOC ink film 208 and thereby possibly compromising security features that have been meticulously developed over decades. Additionally, in some process color overprint applications (e.g., dye based ink jet printing), the white SOC ink film 208 may provide insufficient primer to secure the digital overprint in some environments (e.g., water, alcohol).

Figure 3:
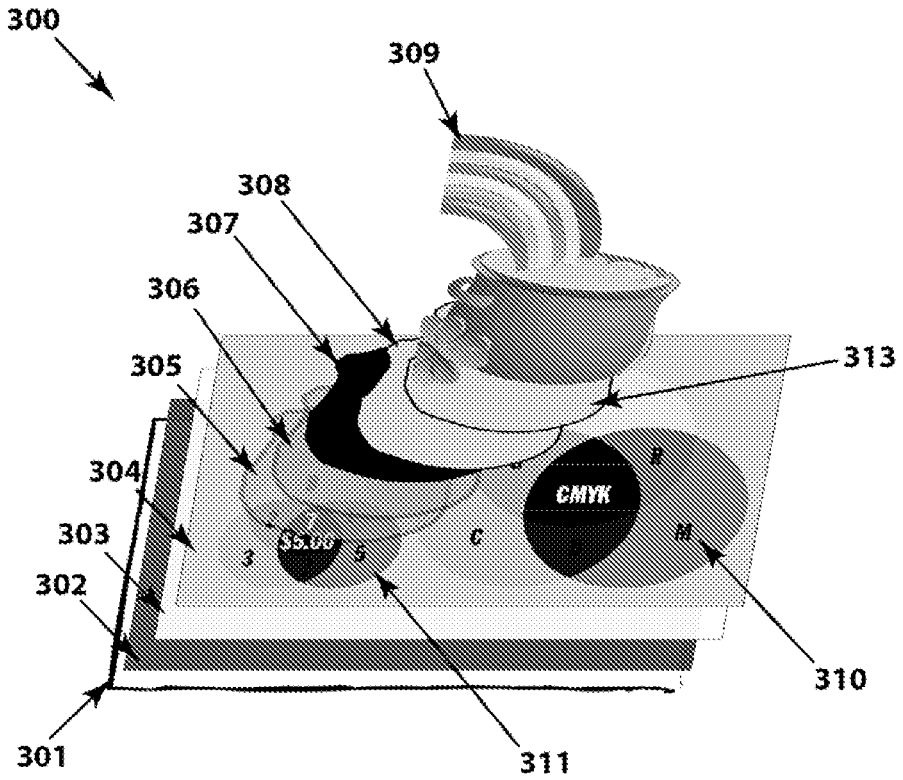
FIG. 3 is an exploded top isometric view of a second preferred representative example of a lottery-type instant ticket security SOC ink film stack compatible with CMYK digital imaging of variable indicia, display, and overprint.

FIG. 3 illustrates a preferred embodiment of an enhanced security protected document 300 in which this disadvantage of a modified white SOC is mostly overcome by applying the overprint primer 313 as a separate discrete ink film, thereby leaving the underlying white SOC largely unaltered. The overprint ink film 313 provides the necessary primer base for the subsequent ink jet overprint 309 that provides a foundation that imparts water and optionally alcohol fastness to the applied ink jet image droplets as well as enhancing the sharpness and vibrancy on the ink jet image. The overprint primer 313 chemistry is primarily water soluble and/or amine complex water soluble resin binder system such as polyvinylpyrrolidone, polyvinyl alcohol, or an acrylic copolymer. The overprint primer 313 would also contain fillers such as silicon dioxide, talc, calcium carbonate, and others. The inorganic fillers would contribute to absorption of water from the ink jet ink.

The remainder of preferred embodiment of the document 300 is identical to the embodiment of the document 200 of FIG. 2 with a paper or other substrate 301 (FIG. 3) with a lower opacity 302 and subsequent contrast 303 and primer 304 layers all typically flood coated. The process color indicia 311 and display 310 are then ink jet imaged on top of the primer. As before the sealer ink film layer 305 saturates the underlying primer 304 layer, thereby rendering the primer 304 chemically inactive to subsequent ink film layers applied on top of the sealer ink film layer 305. The seal coat 305 could be applied either flood coated or confined just to the variable indicia area 311 of the document (as illustrated in FIG. 3). In either case, the seal coat 305 provides protection for the printed process color imaging, as well as effectively rendering the primer coating 304 effectively chemically inert, thereby allowing prior art formulated ink films to be printed on top of the seal coat 305 without the need for significant modifications of the top ink films. The first of these prior art ink films is a release coat 306 spot applied on top of the sealer 305 thereby ensuring that any subsequent ink films printed on top of the release coat are removable by scratching. On top of the release ink film coating 306, an UBB opacity layer 307 is printed, providing upper security against candling along with protection from fluorescence attacks. Printed on top of the UBB 307 is a typical white SOC base 308 that provides a neutral background for the overprint primer 313 and overprint images 309.

Thus, the preferred embodiment of the document 300 has the advantage of enabling a substantially unaltered prior art scratch-off ink stack to be compatible with process color digital imaging. However, this embodiment has the disadvantage of at least one additional ink film layer.

Figure 4:
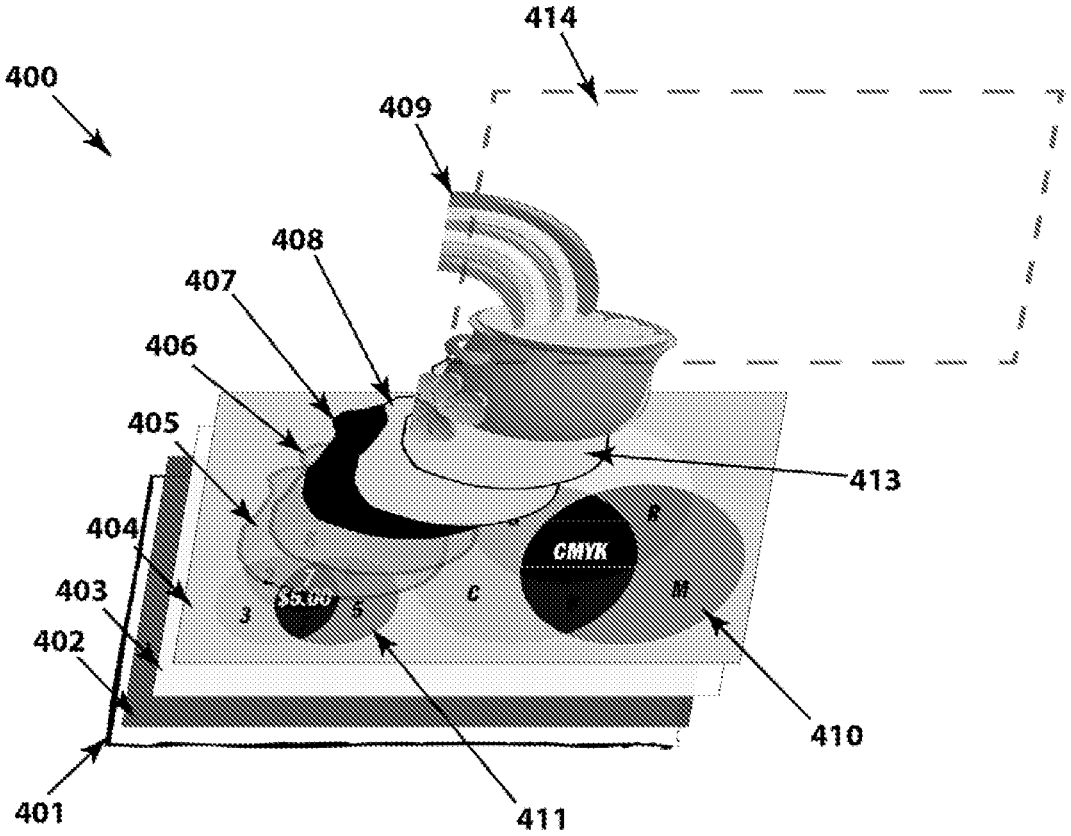
FIG. 4 is an exploded top isometric view of a third representative example of a lottery-type instant ticket security SOC ink film stack compatible with process color digital imaging of variable indicia, display, and overprint embodiments of FIGS. 2 and 3 with the addition of a gloss ink film layer.

Embodiment 400 of FIG. 4 adds a clear, colorless, and transparent overprint 414 to the overprint image 409 and optionally to the display area 410 of either embodiment 200 of FIG. 2 or embodiment 300 of FIG. 3. The clear, colorless, and transparent overprint imparts an aesthetically pleasing gloss appearance, as well as provided additional protection, thereby ensuring a stable and uniform appearance for digitally imaged process colors when accidentally wetted with various solutions—e.g., water, alcohol, cola. However, it is essential that the clear, colorless, and transparent overprint 414 (FIG. 4) does not negatively impact the scratch-off qualities of the document, resulting in more exertion being required to remove the SOC, or greater scratch-off debris to any significant extent. The clear, colorless, and transparent overprint 414 chemistry can be either water based, direct energy curable, or solvent based.

For a water based clear, colorless, and transparent overprint 414, a styrenated acrylic resin system utilizing low Tg (glass transition temperature) emulsions combined with low Tg solution resins is one general possibility. However, it is essential that the final clear, colorless, and transparent overprint 414 formulation ensures that no blocking or sticking together of the ink's components occurs. To help with this anti-blocking requirement as well as to enhance the ability of a "coin" to readily scratch the surface, a micronized polypropylene wax additive (generally known for non-skid attributes) is preferred. The water based clear, colorless, and transparent overprint 414 should preferably be a water based resin system such as: styrenated acrylic, water based urethanes, ethylene vinyl chlorides, styrenated maleic anhydrides, etc.

For a direct energy curable (UV) clear, colorless, and transparent overprint 414 embodiment, urethane acrylates with a low Tg coupled with acrylates monomers would be preferred. One such monomer would be ethoxylated TMPTA (Trimethylolpropane triacrylate). As before, a good additive for anti-blocking and "coin" grab (coins are typically used to scratch off the SOC) would be micronized polypropylene wax. In general, the direct energy curable clear, colorless, and transparent overprint 414 should avoid highly cross linked systems in order to promote optimized scratch characteristics.

The remainder of the document 400 with the clear, colorless, and transparent overprint 414 is identical to embodiment 300 of FIG. 3 with a paper or other substrate 401 (FIG. 4) coated with a lower opacity 402 and subsequent contrast 403 and primer 404 layers all typically flood coated. The process color indicia 411 and display 410 are then ink jet imaged on top of the primer. As before the sealer ink film layer 405 saturates the underlying primer 404 layer, thereby rendering the primer 404 chemically inactive to subsequent ink film layers applied on top of the sealer ink film layer 405. The seal coat 405 could be applied either flood coated or confined just to the variable indicia area 411 of the document (as illustrated in FIG. 4). In either case, the seal coat 405 provides protection for the printed process color imaging, as well as effectively rendering the primer coating 404 effectively chemically inert, thereby allowing prior art formulated ink films to be printed on top of the seal coat 405 without the need for significant modifications of the top ink films. The first of these prior art ink films is a release coat 406 spot applied on top of the sealer 405 thereby ensuring that any subsequent ink films printed on top of the release coat are removable by scratching. On top of the release ink film coating 406, an UBB opacity layer 407 is printed, providing upper security against candling along with protection from fluorescence attacks. Printed on top of the UBB 407 is a typical white SOC base 408 that provides a neutral background for the overprint primer 413 and overprint images 409.

Figure 5:
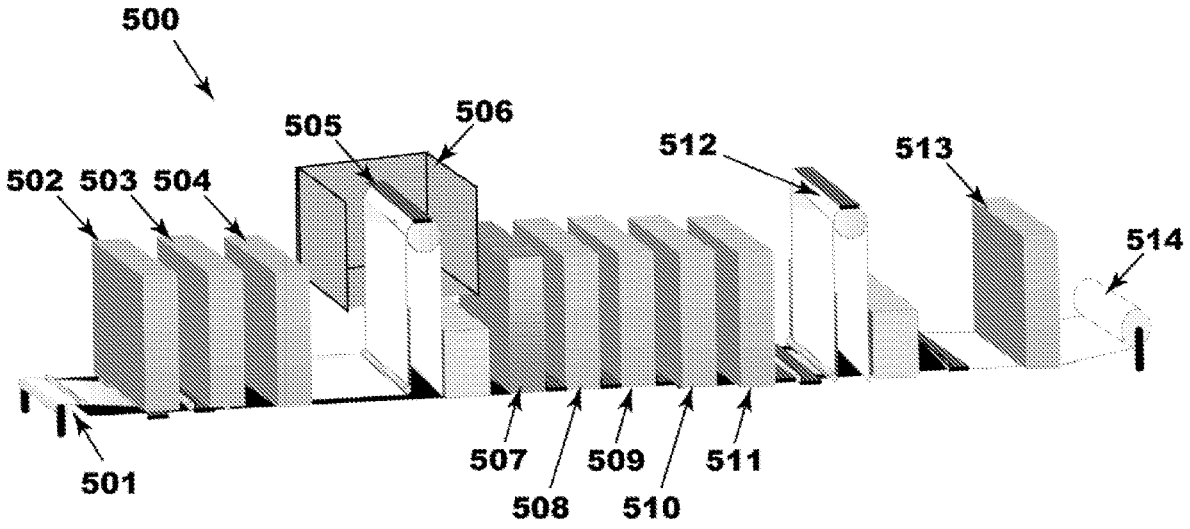
FIG. 5 is a schematic front isometric view of an exemplary embodiment of inline redundant digital imagers and SOC flexographic applications capable of printing the SOC ink film stack compatible with process color digital imaging of variable indicia, display, and overprint embodiments of FIG. 2 through FIG. 4; and, FIG. 6 is a flowchart illustrating the steps necessary to produce a SOC ink film stack compatible with process color digital imaging of variable indicia, display, and overprint of FIG. 2 through FIG. 4.
Figure 6:
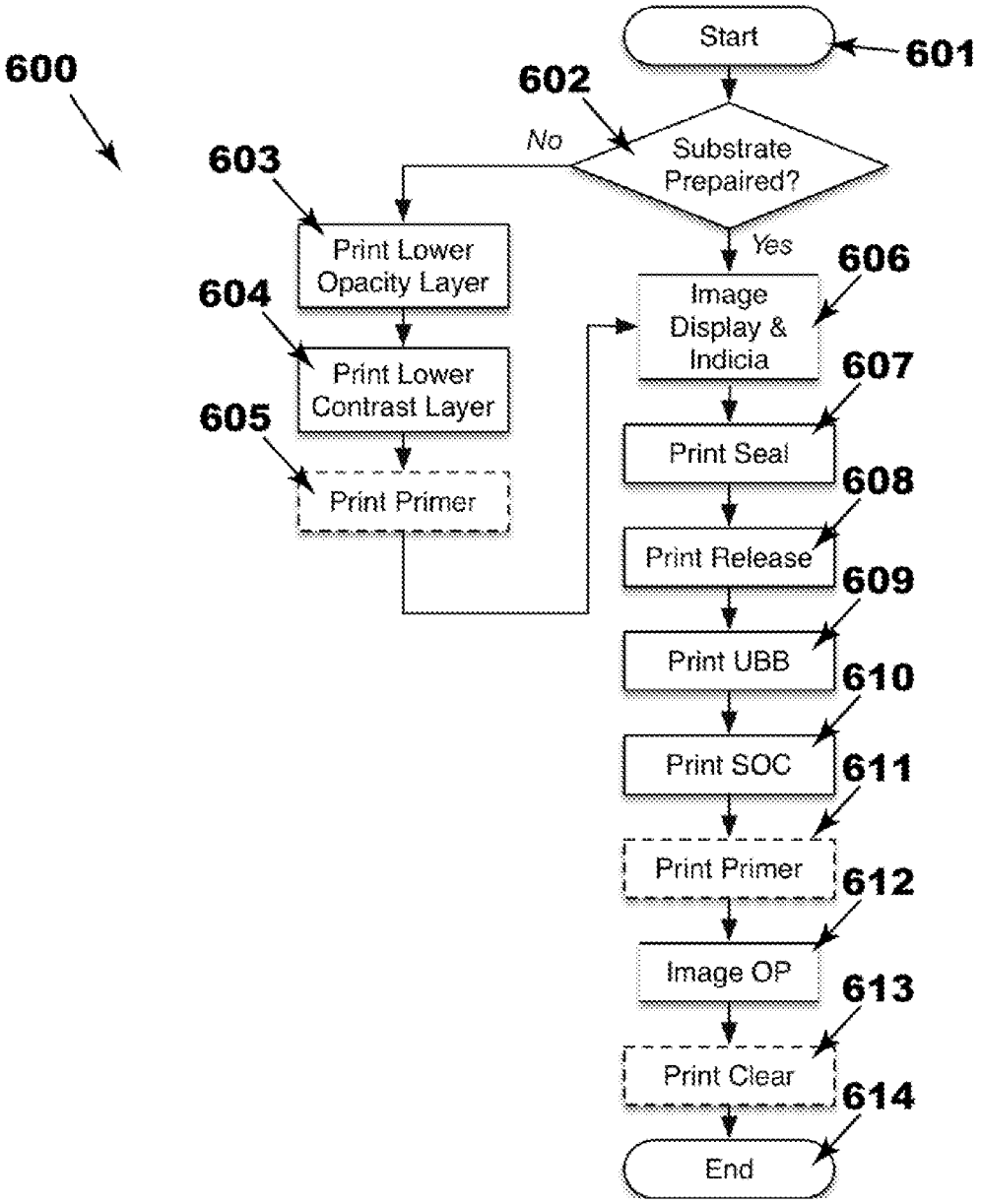

FIGS. 5 and 6, taken together, illustrate one general embodiment describing a digital imager instant ticket printing line capable of producing the exemplary tickets or documents of FIGS. 2 through 4. FIG. 5 illustrates a schematic front isometric view of an embodiment of a digital imager instant ticket printing line while FIG. 6 illustrates the operational flowchart for the same embodiment.

FIG. 5 is a schematic front isometric view of an embodiment of a digital imager instant ticket printing line 500 capable of printing the exemplary ticket or document of FIGS. 2 through 4. In the embodiment of printing line 500, paper is supplied to the printing line via web feed 501 being pulled into a series of three optional fixed plate (e.g., flexographic) print stations 502, 503, and 504 where the lower blocking layer, lower contrast layer, and lower primer are flood coated printed on the virgin web stock. Alternatively, these initial fixed plate print stations 502, 503, and 504 can be omitted if paper stock is supplied pretreated with the previously described lower ink film layers.

Regardless of the initial configuration of digital imager instant ticket printing line 500, the lower security coated web stock is then applied to first digital imager 505 where the ticket or document's secure variable indicia portion 211 (FIG. 2) is printed as well as the ticket or document's display portion 210. Typically, the secure digital imager 505 (FIG. 5) is enclosed in its own, limited access, secure area 506 thereby enhancing security. After the digital imager 505, the web passes through a series of inline fixed plate (e.g., flexographic) printing stations 507 through 511. A seal coat is applied by station 507 with its corresponding release coat applied by station 508 (enabling subsequent coatings to scratch-off). At least one opacity coating (opacity coat) is applied by station 509. A white SOC (white coat) is applied by 510 with the overprint primer applied by station 511. The web stock is then routed to second digital imager 512 where the overprint portion 209 (FIG. 2) is printed. Optionally, a full cover clear glossy protective coating can be applied by a final fixed plate print station 513 (FIG. 5) with the web take-up reel 514 collecting the printed stock for further processing by a packaging line.

FIG. 6 provides the operational flowchart 600 for the exemplary digital imager instant ticket printing line of FIG. 5. The flowchart of FIG. 6 starts 601 by considering 602 the nature of the base paper stock to be printed. If the stock is pretreated with the lower security layers previously described, the display and indicia are digitally imaged 606 directly on the pretreated stock. Alternatively, if the stock is virgin paper, a lower opacity layer 603 is flood coated over at least one side of the stock. The white or gray contrast layer is then flood coated printed 604 on top of the lower opacity layer. In some embodiments this flood coated lower contrast layer may also include the primer for the digitally imaged variable indicia and display. However, in other embodiments (e.g., dye based imaging), at least one optional primer coating is printed 605 over the contrast layer 604 to ensure sufficient primer ink film thickness.

Once the display and variable indicia are imaged 606, a clear seal coat is printed 607 at least on top of the variable indicia and optionally flood coating the entire ticket or document's surface. On top of the clear seal coat a clear release coat is printed 608 with an UBB 609 and white SOC 610 (white coat) subsequently printed on top of the release coat ink film. In some embodiments, the SOC will also contain the primer necessary to provide a foundation for the digitally imaged overprint; however, in other embodiments (e.g., dye based imaging) at least one additional layer of primer 611 will be optionally printed. Next, the OverPrint (OP) is digitally imaged 612 on top of the SOC and/or primer. Finally, an optional clear, glossy, decretive and protection flood coat may also be printed 613 delivering the finished product for packaging 614.

Of course, there are other variations of the disclosed embodiments that are apparent to anyone skilled in the art in view of this disclosure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A security-enhanced Scratch-Off Coating (SOC) secured document with a plurality of SOC ink film coatings, the security-enhanced document comprising:

a substrate, wherein lower opacity and contrast layers are sequentially printed on the substrate;

a first process color hydrophilic primer;

a digitally imaged process color variable indicia printed on the first process color hydrophilic primer;

a clear, colorless, and transparent seal coat positioned over the digitally imaged process color variable indicia and at least a portion of the first process color hydrophilic primer;

a release coat positioned over the portion of the first process color hydrophilic primer and the digitally imaged process color variable indicia;

an upper scratch-off opacity layer positioned over at least a portion of the release coat and the digitally imaged process color variable indicia;

a white scratch-off coating chemically modified to include a second process color hydrophilic primer, wherein the white scratch-off coating including the second process color hydrophilic primer is positioned over at least a portion of the upper scratch-off opacity layer and the digitally imaged process color variable indicia; and a digitally imaged process color overprint printed on the white scratch-off coating including the second process color hydrophilic primer.

2. The document of claim 1 wherein the seal coat is water based and comprises one of resin and Ethylene-Vinyl Chloride (EVCL).

3. The document of claim 1 wherein the seal coat is a free radical based Ultraviolet (UV) direct energy curable ink.

4. The document of claim 3 wherein the direct energy curable seal coat is primarily comprised of oligomers.

5. The document of claim 4 wherein the oligomer direct energy curable seal is primarily comprised of acrylic acrylates combined with acrylate monomers.

6. The document of claim 3 wherein the direct energy curable seal coat is made using cycloaliphatic diepoxides.

7. The document of claim 1 wherein the seal coat is flexographically deposited via an application anilox roller with volumes of 24 BCM (Billion Cubic Microns) or greater.

8. The document of claim 1 wherein the second process color hydrophilic primer includes a water soluble polyvinylpyrrolidone resin binder.

9. The document of claim 8 wherein the water soluble second process color hydrophilic primer includes inorganic fillers.

10. The document of claim 1 wherein the first process color hydrophilic primer is a separate ink film layer apart from the contrast layers.

11. The document of claim 1 further comprising:

a clear, colorless, and transparent overprint positioned over the digitally imaged process color overprint printed on the white scratch-off coating including the second process color hydrophilic primer.

12. A method of producing a security-enhanced Scratch-Off Coating (SOC) secured document with a plurality of SOC ink film coatings, the method comprising:

sequentially printing on a substrate lower opacity and contrast layers;

printing a first process color hydrophilic primer;

digitally imaging process color variable indicia on the first process color hydrophilic primer;

printing a clear, colorless, and transparent seal coat over the digitally imaged process color variable indicia and at least a portion of the first process color hydrophilic primer;

printing a release coat over the portion of the first process color hydrophilic primer and the digitally imaged process color variable indicia;

printing an upper scratch-off opacity layer over at least a portion of the release coat and the digitally imaged process color variable indicia;

printing a white scratch-off coating chemically modified to include a second process color hydrophilic primer, wherein the white scratch-off coating including the second process color hydrophilic primer is printed over at least a portion of the upper scratch-off opacity layer and the digitally imaged process color variable indicia; and printing a digitally imaged process color overprint over the white scratch-off coating including the second process color hydrophilic primer.

13. The method of claim 12 wherein the seal coat is a free radical based Ultraviolet direct energy curable ink.

14. The method of claim 12 wherein the seal coat viscosity is greater than or equal to 25 seconds viscosity as measured with a #2 Zahn cup.

15. The method of claim 12 wherein the seal coat is flexographically deposited via an application anilox roller with volumes of 24 BCM or greater.

16. The method of claim 12 wherein one of the seal coat and the release coat is flood coated over the entire front of the document.

17. The method of claim 12 wherein the first process color hydrophilic primer is a separate ink film layer apart from the contrast layers.

18. The method of claim 12 further comprising:

printing a clear, colorless, and transparent overprint over the digitally imaged process color overprint printed on the white scratch-off coating including the second process color hydrophilic primer.

19. A security-enhanced Scratch-Off Coating (SOC) secured document with a plurality of SOC ink film coatings, the security-enhanced document comprising:

a substrate, wherein lower opacity and contrast layers are sequentially printed on the substrate;

a first process color hydrophilic primer;

a digitally imaged process color variable indicia printed on the first process color hydrophilic primer;

a clear, colorless, and transparent seal coat positioned over the digitally imaged process color variable indicia and at least a portion of the first process color hydrophilic primer;

a release coat positioned over the portion of the first process color hydrophilic primer and the digitally imaged process color variable indicia;

an upper scratch-off opacity layer positioned over at least a portion of the release coat and the digitally imaged process color variable indicia;

a white scratch-off coating chemically modified to include a second process color hydrophilic primer, the combined white scratch-off coating and the second process color hydrophilic primer positioned over at least a portion of the upper scratch-off opacity layer and the digitally imaged process color variable indicia; and a digitally imaged process color overprint printed directly on the combined white scratch-off coating and second process color hydrophilic primer without an intervening layer.

* * * * *